US006725475B1

(12) United States Patent
Chen

(10) Patent No.: US 6,725,475 B1
(45) Date of Patent: Apr. 27, 2004

(54) FOLDABLE MECHANISM FOR A BASE OF PLAYYARD

(75) Inventor: Shun-Min Chen, Taipei Hsien (TW)

(73) Assignee: Kenny Cheng, Taipei (TW)

( * ) Notice: Subject to any disclaimer, the term of this patent is extended or adjusted under 35 U.S.C. 154(b) by 0 days.

(21) Appl. No.: 10/302,515

(22) Filed: Nov. 22, 2002

(51) Int. Cl.[7] ..... A47D 13/06
(52) U.S. Cl. ..... 5/98.1; 5/99.1; 402/102
(58) Field of Search ..... 5/98.1, 99.1; 403/102

(56) References Cited

U.S. PATENT DOCUMENTS

| | | | | | |
|---|---|---|---|---|---|
| 4,811,437 | A | * | 3/1989 | Dillner et al. | 5/99.1 |
| 5,819,342 | A | | 10/1998 | Williams | |
| 6,259,667 | B1 | | 7/2001 | Kuang et al. | |
| 6,305,037 | B1 | * | 10/2001 | Cheng | 5/99.1 |
| 6,336,234 | B1 | * | 1/2002 | Kuo | 5/99.1 |
| 6,349,434 | B1 | * | 2/2002 | Zhuang | 5/99.1 |
| 6,510,569 | B1 | * | 1/2003 | Hu | 5/99.1 |

* cited by examiner

*Primary Examiner*—Michael F. Trettel
(74) *Attorney, Agent, or Firm*—Gauthier & Connors, LLP

(57) ABSTRACT

A foldable mechanism for a seat of a playyard comprising a center seat pivotally connecting with a plurality of bars with pins; a stationary block having horizontal grooves and being fixed in the center seat; a movable block having inclined grooves; movable pins penetrating the horizontal grooves of the stationary block and inclined grooves of the movable block so as to restrict pivotally moving of the bars; and a resilient element being positioned between the stationary block and the movable block. When the movable block is pulled up, the movable pins in the inclined grooves of the movable block move toward center of the seat, so that restriction of pivotally rotation of the bars by the movable pins is removed, the bars are rotating vertically, the seat of the playyard is collapsed, and then the movable pins move back to the original positions by the recovery force of the resilient element. While the center seat is pressed, the movable block again moves toward the center of the seat, the bars are rotating horizontally, then the movable pins move back to the original positions, so that pivotally rotation of the bars is again restricted by the movable pins.

4 Claims, 5 Drawing Sheets

FOLDABLE MECHANISM FOR A BASE OF PLAYYARD

BACKGROUND OF THE INVENTION

1. Field of the Invention

This invention relates to a foldable mechanism, and more specifically to a foldable mechanism for a base of a playyard.

2. Description of Related Arts

A wide variety of playyards, which are also referred to as playpens, have been designed, developed, and commercialized for many years. In city life, the living space is crowded. If a playyard can not be stored in a small size, it will be troublesome. For solving the storage problem, playyards are usually designed to be foldable for storage.

In U.S. Pat. No. 5,819,342, disclosed is a foldable playyard with a latch locking hub system, comprising a lower frame assembly including a hub and a plurality of hub legs, an upper frame assembly comprising a plurality of side rail units, and corner legs. In view of FIG. 2 of the US '342 patent (FIG. 1 in the specification), it is clear that the hub unit of the US patent is constructed by a plurality of complicated elements, and thus its structure is complicated and the manufacturing cost thereof is higher.

Further, in U.S. Pat. No. 6,259,667, disclosed is a lower frame structure of a foldable playyard comprising a hub being operable to lock the lower frame structure at an erected state and to unlock the lower frame structure to allow it to collapse to a collapsed state; four hub legs, one end portion of each of the hub legs being pivotally coupled to the hub such that the hub legs are capable of pivotal movement in a longitudinal direction of the hub between an erected position and a collapsed position; and a first L-shaped auxiliary supporting tube pivotally coupled to a first hub leg at a coupling end thereof and a second auxiliary supporting tube pivotally coupled to a third hub leg at a coupling end thereof and arranged such that the auxiliary supporting tubes may pivot in a direction parallel to the axial direction of the hub leg. From FIG. 2 of the patent (FIG. 2 of the specification), it is found that the hub is also constructed by a plurality of elements, which again will raise the manufacturing cost of the playyard.

In the prior art references cited above, the foldable structure for the base of the playyard uses many parts, which not only complicate the structure but also increase the cost thereof.

In view of the sharp increase in the business of playyard fields, designing less complicated structures for the foldable mechanism of the base of the playyard has become of paramount importance.

SUMMARY OF THE INVENTION

The invention is aimed at overcoming the problems existing in the prior art.

It is, therefore, an object of the invention to provide a foldable mechanism for the base of playyard, which can simplify the structure of the foldable mechanism and reduce the number of parts used therein.

To accomplish the above objects, according to the invention, there is provided a foldable mechanism for a base of a playyard comprising: a center seat pivotally connected with a plurality of bars with pins; a stationary block having horizontal grooves and being fixed in the center seat; a movable block having inclined grooves; movable pins penetrating the horizontal grooves of the stationary block and inclined grooves of the movable block so as to restrict the pivotal movement of the bars; and a resilient element being positioned between the stationary block and the movable block.

When the movable block is pulled up, the movable pins in the inclined grooves of the movable block move toward the center of the seat, so that restriction of the pivotal rotation of the bars by the movable pins is removed. The bars are rotating vertically, the seat of the playyard is collapsed, and then the movable pins move back to the original positions by the recovery force of the resilient element, while the center seat is pressed. The movable pins in the inclined grooves of the movable block again move toward the center of the seat, the bars are rotating horizontally, and then the movable pins move back to the original positions, so that pivotal rotation of the bars is again restricted by the movable pins.

The foldable mechanism, further comprises a webbing passing through the movable block so as to pull the movable block with the webbing. With the provision of the webbing, users may fold the foldable mechanism easier.

In the foldable mechanism, the movable block is provided with vertical grooves, and stationary pins for fixing the stationary block with respect to the center seat and which penetrates through the vertical grooves, such that the movable block will move vertically.

In the foldable mechanism, the resilient element is preferably a spring.

Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a further understanding of the nature and objects of the invention, reference may be made to the following detailed description taken in conjunction with the accompanying drawings in which.

DETAILED DESCRIPTION OF THE INVENTION

Figure 1:
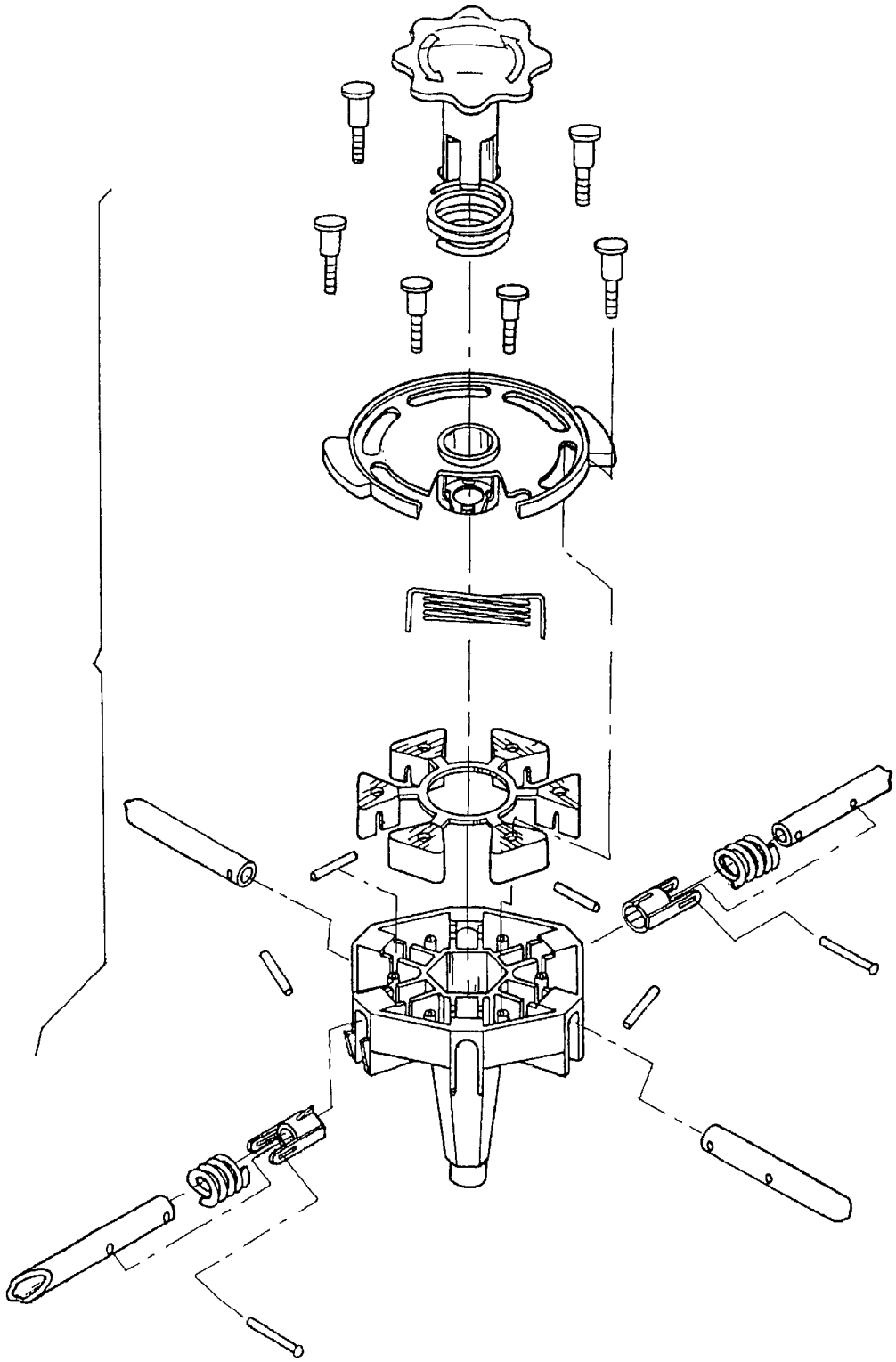
FIG. 1 is an exploded view of the hub unit of a prior art (U.S. Pat. No. 5,819,342)
Figure 2:
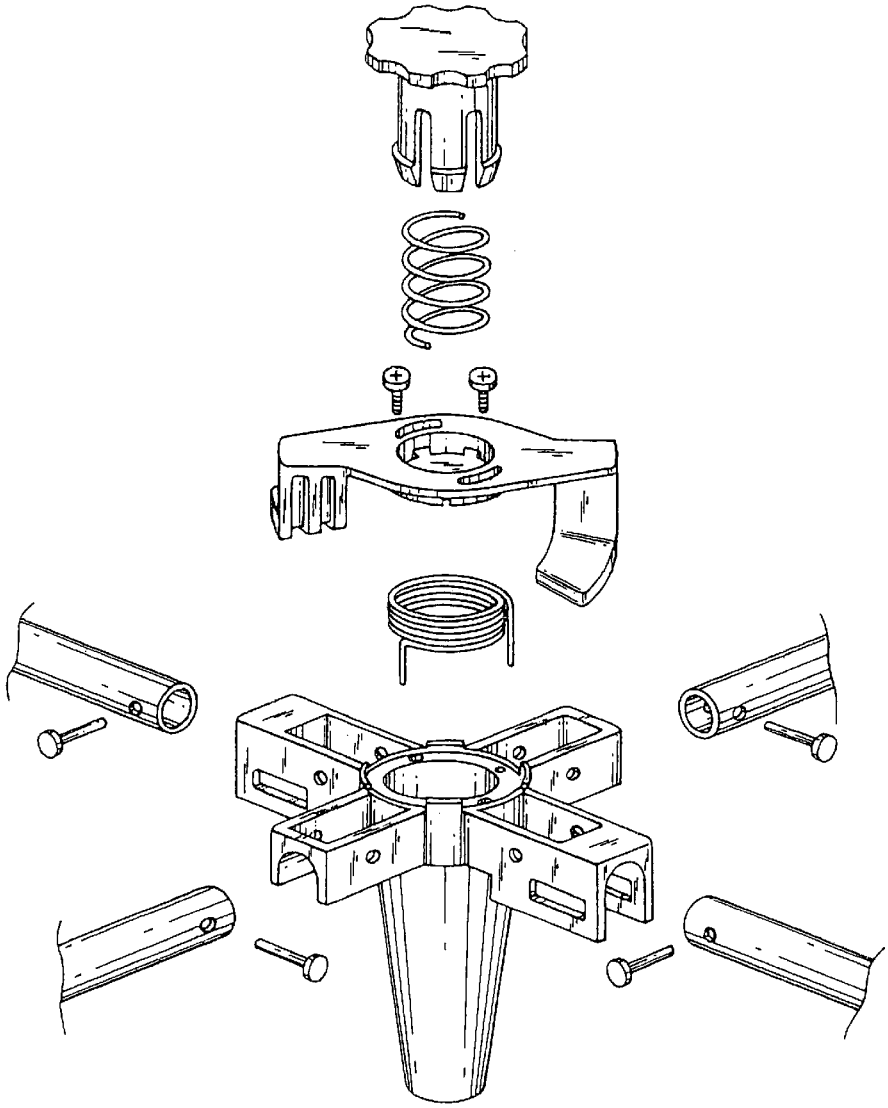
FIG. 2 is an exploded view of the hub of another prior art (U.S. Pat. No. 6,295,667)
Figure 3:
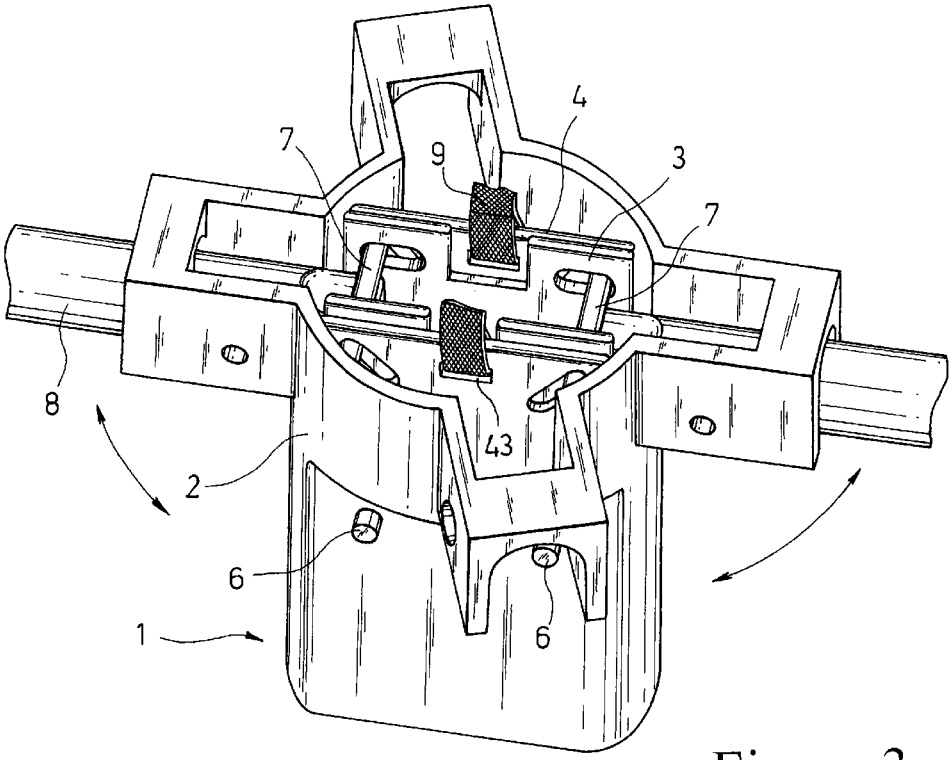
FIG. 3 is a perspective view of the foldable mechanism for the base of the playyard of the invention.
Figure 4:
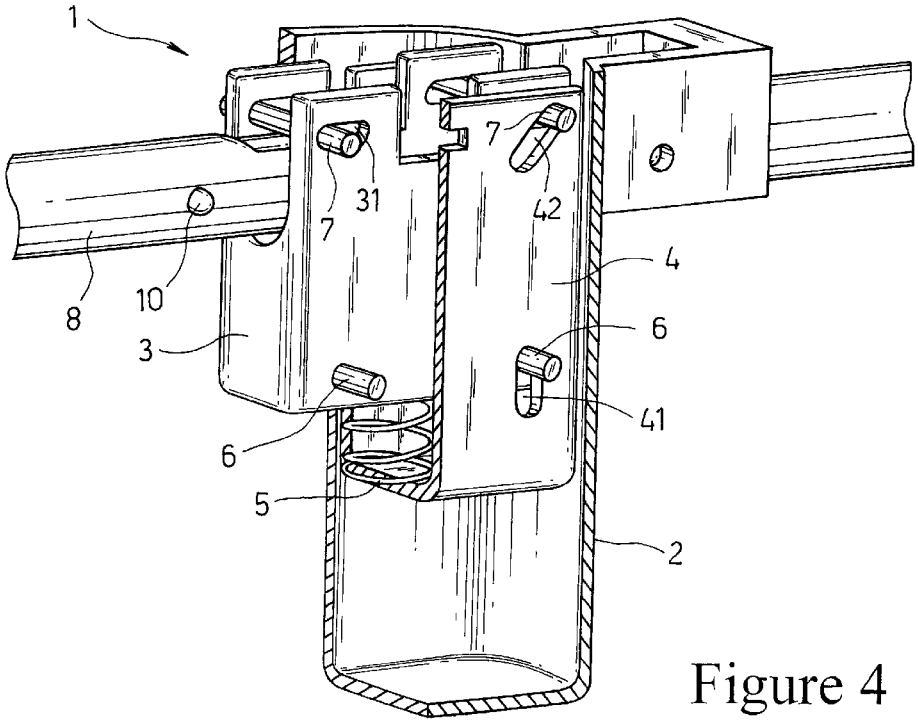
FIG. 4 is a partial exploded view of the foldable mechanism for the base of the playyard of the invention.
Figure 5:
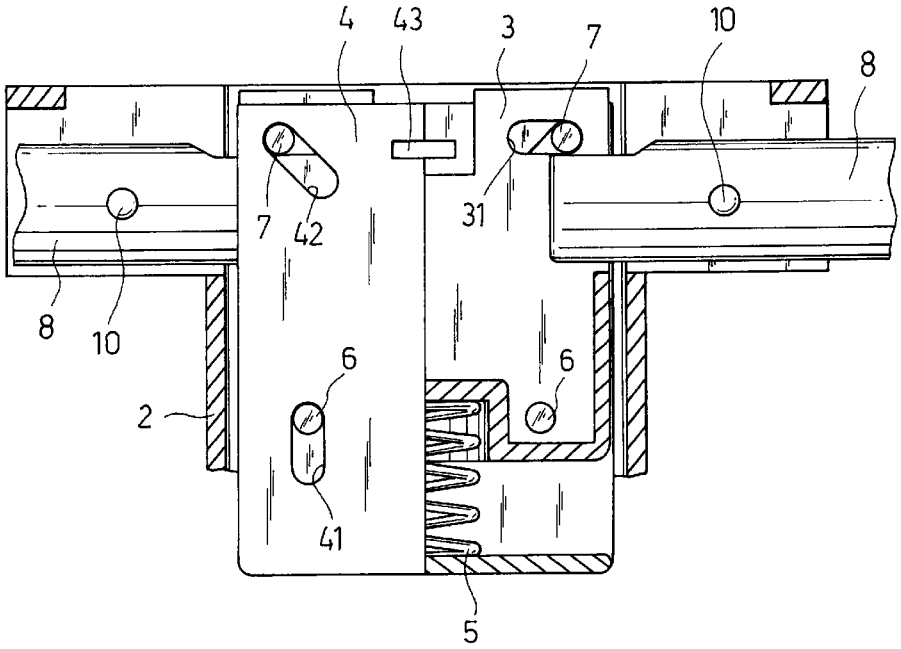
FIG. 5 is a partial-section rear view of the foldable mechanism for the base of the playyard of the invention, where portions of the center seat and the movable block are removed.
Figure 6:
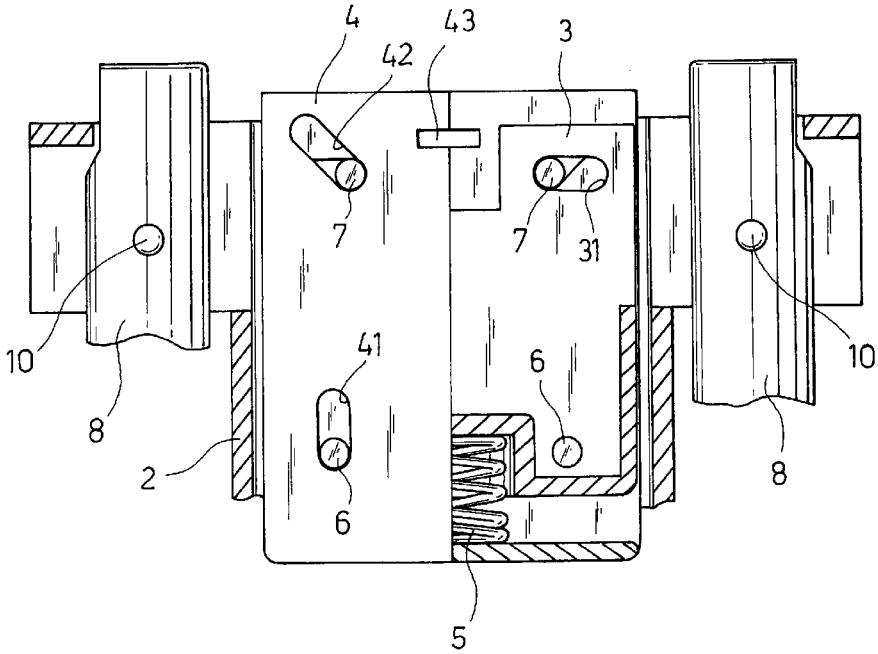
FIG. 6 shows a folded status of the foldable mechanism for the base of the playyard of the invention.
Figure 7:
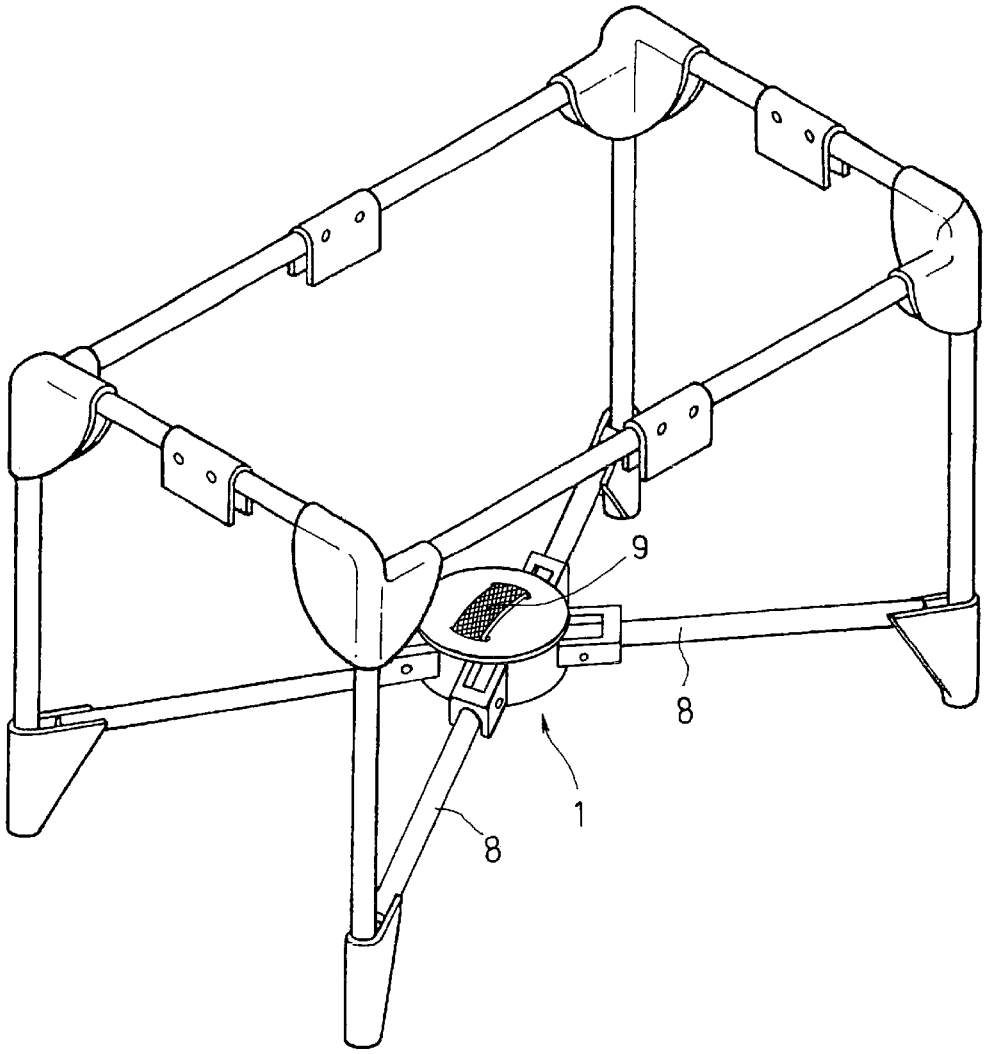
FIG. 7 is a perspective view showing the foldable mechanism for the base of the playyard of the invention applied in a playyard.

A preferred embodiment of the invention will be described hereinbelow with reference to the FIGS. 3 to 7.

In FIGS. 3 to 7, the foldable mechanism 1 is for a base of a playyard of the invention; 2 is for the center seat; 3 is for the stationary block; 4 is for the movable block; 5 is for the spring; 6 are for the fixed pins; 7 are for the movable pins; 8 are for the bars; and 9 is for the webbing.

As shown in the figures, the stationary block 3, the movable block 4, the resilient element 5 (which is a spring in this embodiment), and parts of the left and right bars 8 are accommodated in the center seat 2. Two fixed pins 6 respectively longitudinally penetrate the left and right sides of a lower portion of the stationary block 3 and the center seat 2 so as to fix them together. The fixed pins 6 also penetrate vertical grooves 41 provided in left and right sides of a lower portion of the movable block 4 respectively. Two movable pins 7 respectively longitudinally penetrate left and right horizontal grooves 31 in an upper portion of the stationary block 3 and left and right slant grooves 42 in an upper portion of the movable block 4, and is movable within the grooves. Left and right pins 10 pivotally fixed left and right bars 8 respectively in left and right reserve U-shaped arms of the center seat 2. The pivotal rotation of the bars 8 are restricted by the movable pins 7 during use of the playyard. A spring 5 is provided between the bottom of the stationary block 3 and the bottom of the movable block 4, that is, one end of the spring is fixed on the outer side of the bottom of the stationary block 3, and the other end of the spring 5 is fixed on the inner side of the bottom of the movable block 4. A webbing 9 penetrates through a through hole 43 provided in upper center portion of the movable block 4.

By way of the above structure, during use of the playyard, since the pivotal rotation of the bars 8 are restricted by the movable pins 7, the bars can not rotate, and therefore, the base of the playyard is under an extension status.

When the playyard is going to be folded, the webbing 9 is pulled, and the spring 5 is pressed due to the distance between the stationary block 3 and the movable block 4 being shortened. The stationary block 3 is fixed on the center seat 2 by the fixed pins 6, while the movable block 4 is moved upward due to the pulling of the webbing 9. Owing to the vertical orientation for the fixed pins 6 in the vertical grooves 41 in the movable block 4 and the horizontal orientation for the movable pins 7 in the horizontal grooves 31 in the stationary block 3, the movable pins 7 in the slant grooves 42 of the movable block 4 are forced to move toward the center of the movable block 4. After the movable pins 7 move toward the center of the movable block 4, the restriction of the pivotal rotation of the bars 8 is removed, and the bars 8 may rotate clockwise/counter clockwise respectively, so that the base of the playyard can be folded.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of the construction and combination of arrangement of parts may be resorted to without departing from the spirit and scope of this invention.

What is claimed is:

1. A foldable mechanism for a base of a playyard comprising:

a center seat pivotally connected with a plurality of bars with pins;

a stationary block having horizontal grooves and being fixed in the center seat;

a movable block having inclined grooves;

movable pins penetrating the horizontal grooves of the stationary block and inclined grooves of the movable block so as to restrict pivotal movement of the bars; and a resilient element being positioned between the stationary block and the movable block.

2. The foldable mechanism of claim 1, further comprising a webbing passing through the movable block so as to pull the movable block with the webbing.

3. The foldable mechanism of claim 1, wherein the movable block is provided with vertical grooves, and stationary pins for fixing the stationary block with respect to the center seat are penetrating through the vertical grooves, such that the movable block moves vertically.

4. The foldable mechanism of claim 1, wherein the resilient element is a spring.

* * * * *